United States Patent [19]

Campos

[11] Patent Number: 4,790,095

[45] Date of Patent: Dec. 13, 1988

[54] GUNSTOCKS AND GUNSTOCK ATTACHMENTS

[76] Inventor: Conrad H. Campos, P.O. Box 606, Hurricane, Utah 84737

[21] Appl. No.: 92,128

[22] Filed: Sep. 2, 1987

Related U.S. Application Data

[63] Continuation-in-part of Ser. No. 716,099, Mar. 26, 1986, abandoned.

[51] Int. Cl.[4] ..... F41C 23/00

[52] U.S. Cl. ..... 42/73; 42/71.01

[58] Field of Search ..... 42/71.01, 71.02, 72, 42/73

[56] References Cited

U.S. PATENT DOCUMENTS

| | | | |
|---|---|---|---|
| 859,804 | 7/1907 | Daniel | 42/71.01 |
| 1,170,256 | 2/1916 | Hillpot | 42/71.01 |
| 1,277,002 | 8/1918 | Van Name | 42/71.01 |
| 2,104,129 | 1/1938 | Kress | 42/71.01 |
| 2,447,229 | 8/1948 | Bradley | 42/71.01 |
| 3,011,283 | 12/1961 | Lunn et al. | 42/71.01 |
| 4,296,566 | 10/1981 | Campos | 42/73 X |

FOREIGN PATENT DOCUMENTS

| | | | |
|---|---|---|---|
| 419182 | 10/1925 | Fed. Rep. of Germany | 42/71.01 |
| 106412 | 5/1917 | United Kingdom | 42/71.01 |

OTHER PUBLICATIONS

Fajen, R., "Fajen's 'Olympic' Free Rifle Stock", *American Rifleman,* May 1953, p. 65.

*Primary Examiner*—Harold J. Tudor
*Assistant Examiner*—Richard Klein
*Attorney, Agent, or Firm*—Kerkam, Stowell, Kondracki & Clarke

[57] ABSTRACT

A contoured gunstock for fixed hand engagement includes a sideways projecting portion for accommodating a user's trigger hand in combination with an adjustable arm or back engaging attachment fixed to the butt of the gunstock. The sideways projecting portion allows one to most conveniently absorb the recoil of the rifle. The forearm of the rifle may include elongated recesses or grooves to accommodate a user's front hand. Alternately, the forearm of the rifle may advantageously include a flared out hand gripping portion at the front end of the forearm, the hand gripping portion having an increased height and width over the rest of the forearm.

5 Claims, 5 Drawing Sheets

GUNSTOCKS AND GUNSTOCK ATTACHMENTS

CROSS-REFERENCE TO RELATED APPLICATION

This application is a continuation-in-part of application Ser. No. 716,099 filed Mar. 26, 1986 by the present inventor and having the same title and now abandoned.

BACKGROUND OF THE INVENTION

While it is well known in the art to provide arm or shoulder engagement attachments for rifle gunstocks, as exemplified by U.S. Pat. Nos. 3,442,042; 3,209,481, and 3,324,588 to William V. T. Gilbert, and 4,296,566 to Conrad H. Campos, which utilize stock extensions to the back of the user for sighting positionment, it has been found that a conventional stock can be made adequate in absorbing the recoil. The surfaces of the conventional stock, however, are not so configured for the hands of the user to retain maximum grip on the stock to fully absorb the recoil. The length of the stock is such that the butt is seated against the shoulder of the user when in firing position.

The present invention constitutes an improvement over previous gunstocks and provides an improved gunstock for the user, with a shortened gunstock having contoured gripping surfaces which provides maximum grip for complete absorbtion of recoil.

SUMMARY OF THE INVENTION

The present invention provides for the accurate secured positionment of a rifle by a user while in the firing position, with the rifle butt in spaced relationship from the shoulder of the user, thus avoiding contact wit the shoulder at any time.

The improved invention provides for a contoured rifle stock having hand nesting relief areas and improved gripping surfaces, along with appropriate abutments to insure maximum resistance of the rifle recoil action when discharged. This contourment, in combination with a gunstock attachment secured to the rifle butt which includes an adjustable extension arm, and which extends rearwardly parallel to the axis of the gun barrel to engage the arm or back of the user, is more particularly described in my U.S. Pat. No. 4,296,566. The present invention insures accurate and secure positioning of a rifle prior to discharge, and further provides control against rifle recoil and possible injury to the user. The contourment includes a sideways projecting portion with finger and thumb engaging surfaces. A forearm of the rifle provides for improved gripping.

DETAILED DESCRIPTION OF THE INVENTION

Figure 1:
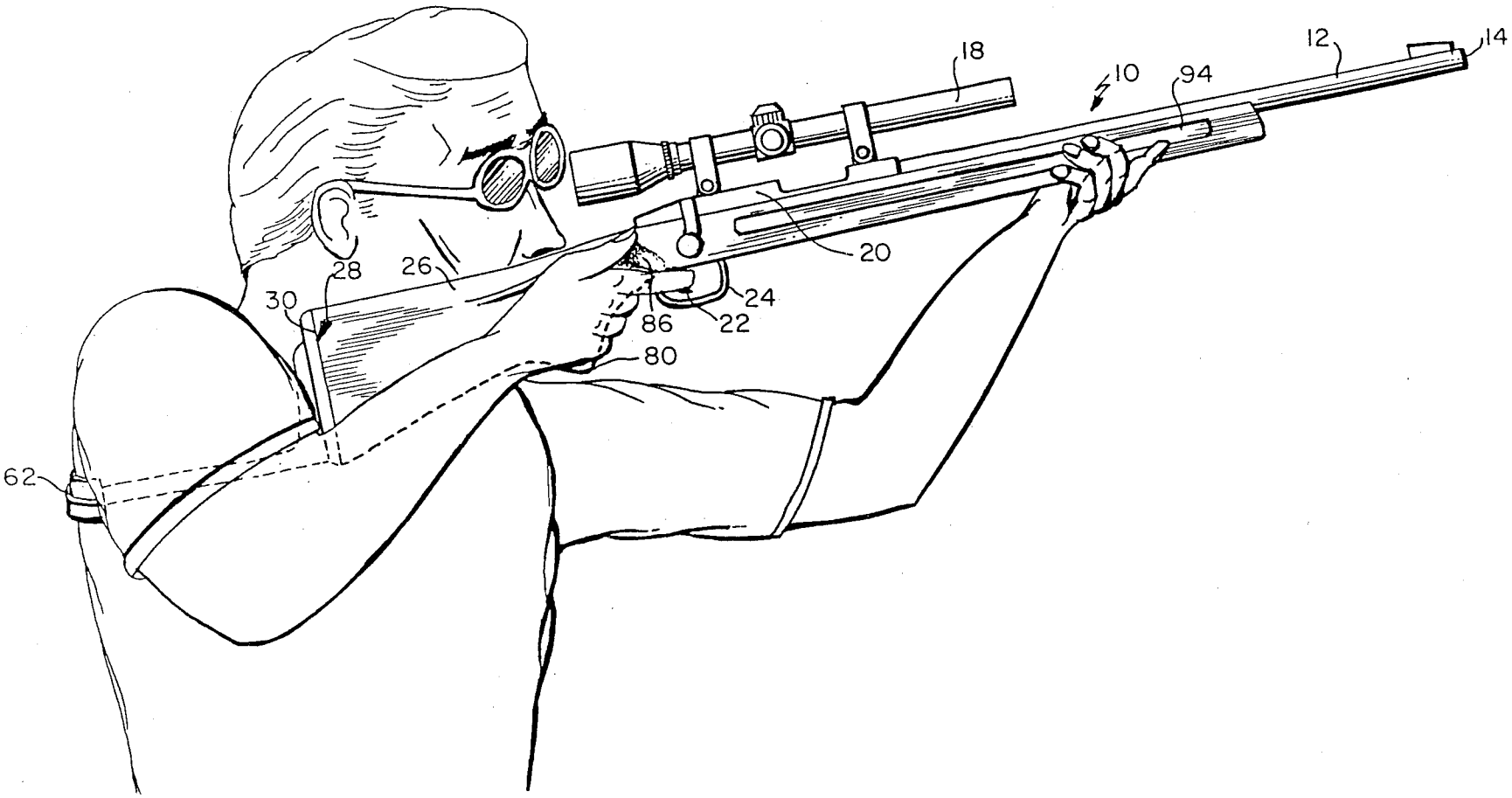
FIG. 1 is a perspective view of the present invention as employed by a rifleman.

Referring now more particularly to the drawings, the firearm or rifle is generally indicated at 10, comprising a barrel 12 having a muzzle 14, and a gunstock 16. A forward portion 17 of the gunstock underlies and supports the barrel 12. A scope 18 is mounted in a conventional manner over the magazine and bolt section 20. Reference numerals 22 and 24 indicate a trigger and a trigger guard respectfully. A cheek engaging portion 26 forms a portion of the stock 16 and terminates in a butt end assembly generally designated 28.

Figure 2:
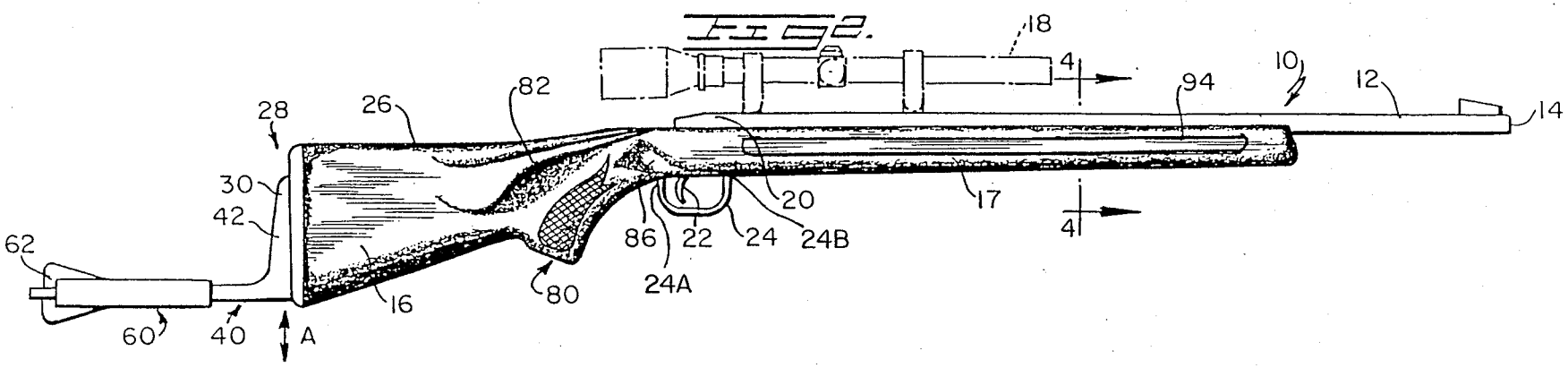
FIG. 2 is a side elevational view of the present invention.
Figure 3:
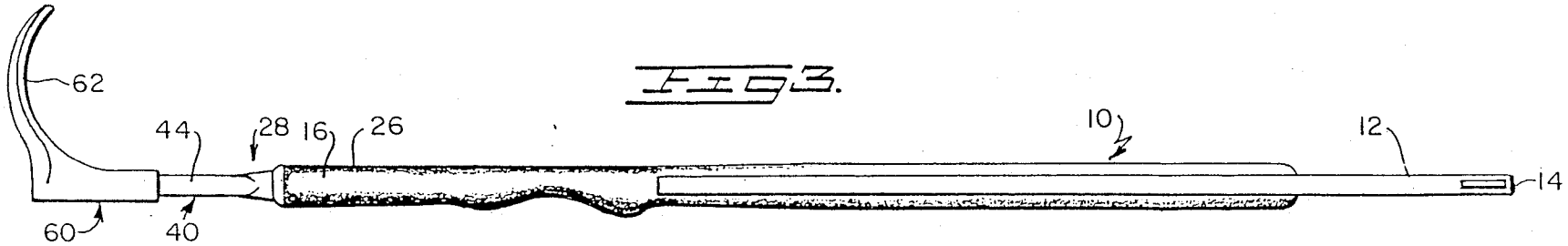
FIG. 3 is a top plan view of a rifle as shown in FIG. 1.
Figure 4:
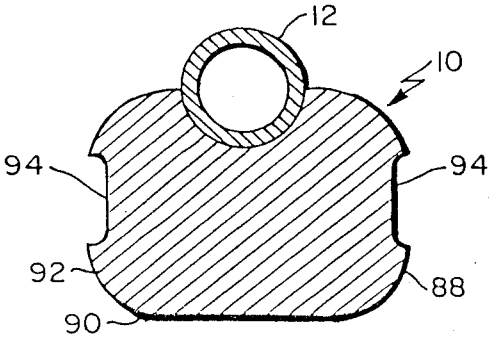
FIG. 4 is an enlarged detailed vertical sectional view taken along line 4—4 of FIG. 2.
Figure 5:
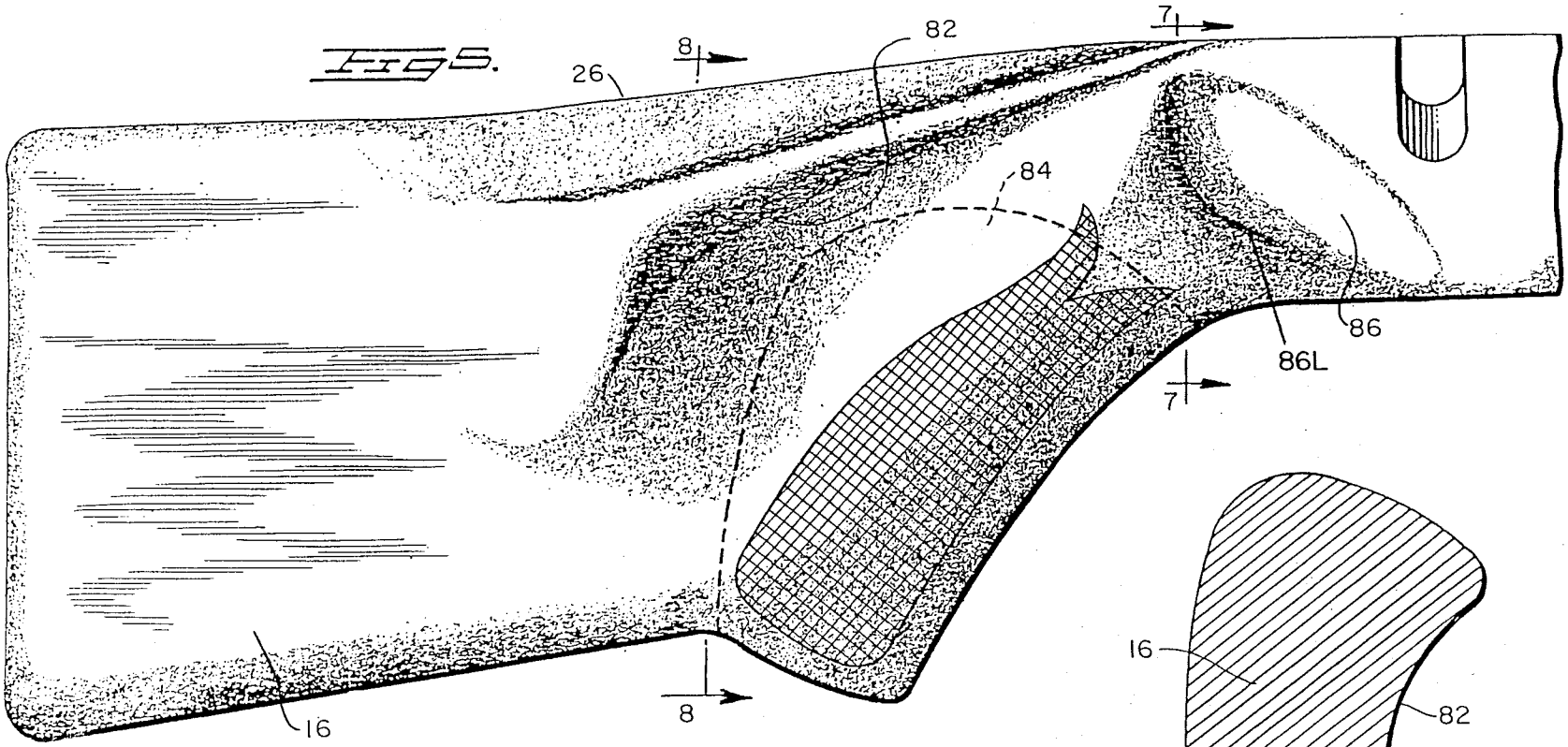
FIG. 5 is an enlarged fragmentary detailed side elevational view of one side of the contoured rifle stock of the present invention.
Figure 8:
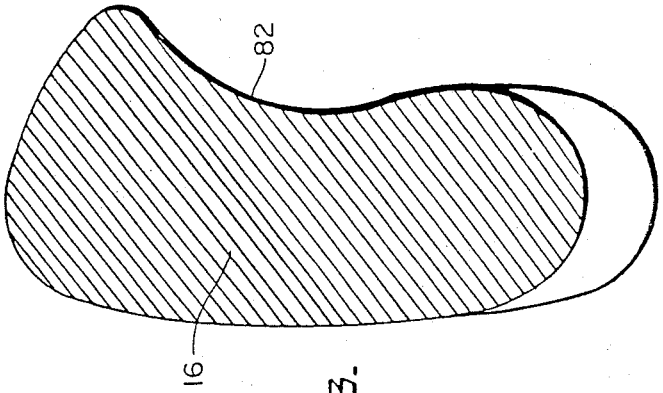
FIG. 8 is an enlarged detailed sectional view taken along line 8—8 of FIG. 5.
Figure 7:
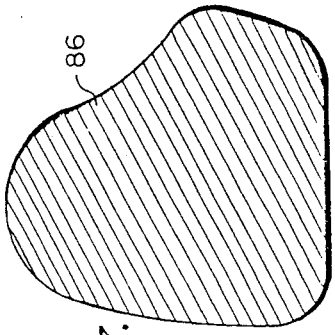
FIG. 7 is an enlarged detailed sectional view taken along the line 7—7 of FIG. 5.

Referring now more particularly to FIGS. 1, 2, and 3, and my prior patent, an attachment includes a butt plate 30 having a portion which forms a track to engage with a track engaging element. The butt plate is provided with bores, not shown, adapted to receive a pair of screws for attachment of the butt plate 30 to the butt end 28 of the gunstock 16.

The assembly 28 further comprises a first gunstock extending member 40 comprising a foot portion 42 and a leg portion 44, which leg portion is normal to the foot portion. The foot portion, as more clearly shown in my prior patent, is provided with a pair of bores of a size to freely receive the threaded shank portion of a pair of bolts. Each of the bores is counterbored to receive the head portion of each of the bolts. Corresponding bores are provided in the rib portion of the track engaging member and the bores are internally threaded to receive the threaded shank of the pair of bolts.

Thus, by loosely attaching a track engaging member to the foot portion by the pair of bolts, the foot and its attached leg may be slid upwardly and downwardly to position the leg portion 44 at a desired height as illustrated by arrow A in FIG. 2.

Details of this part of the present invention are more clearly shown in my prior U.S. Pat. No. 4,296,566, incorporated herein by reference.

Figure 6:
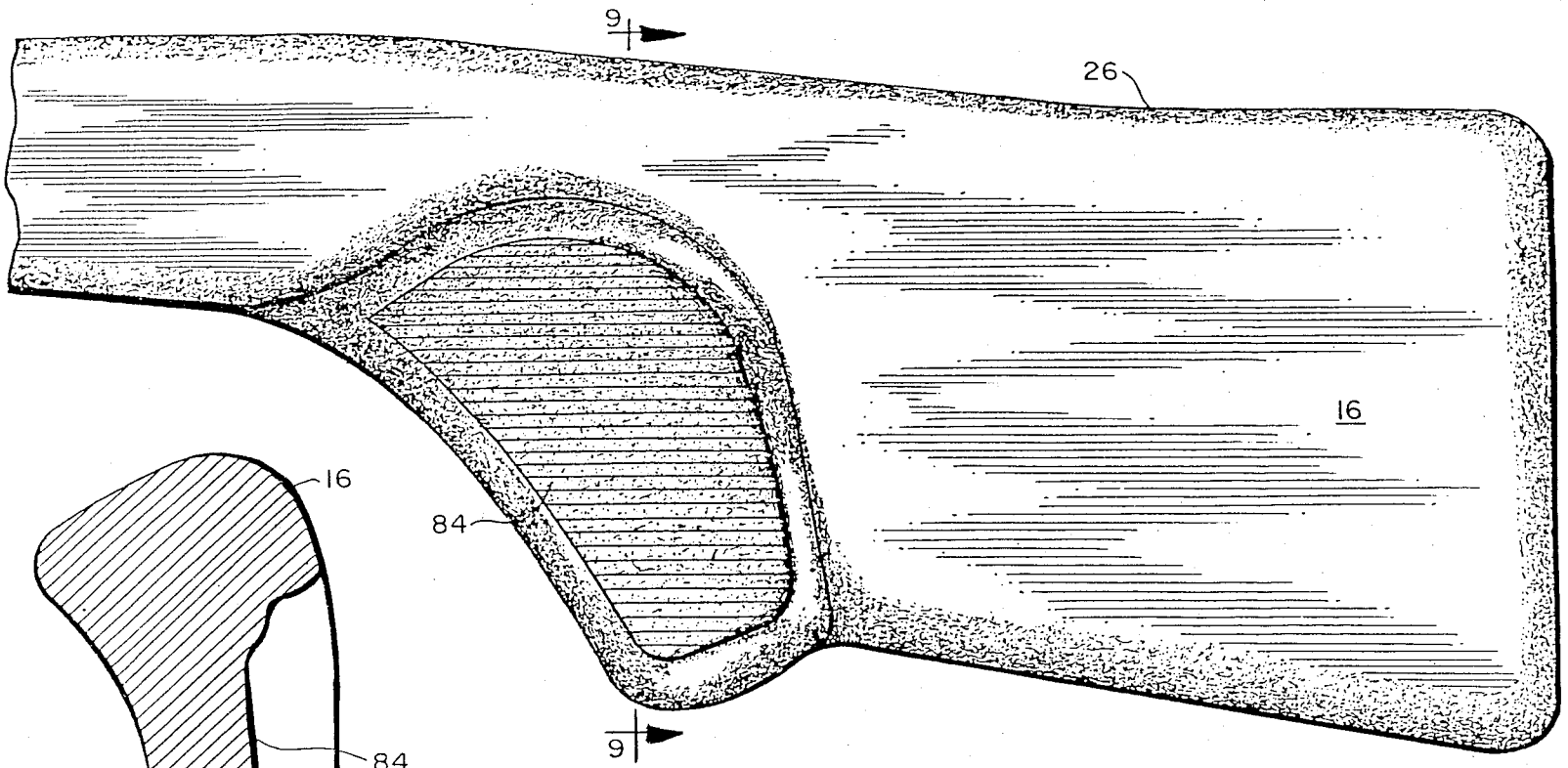
FIG. 6 is an enlarged fragmentary detailed side elevational view of the side opposite to that part of the stock shown in FIG. 5.
Figure 9:
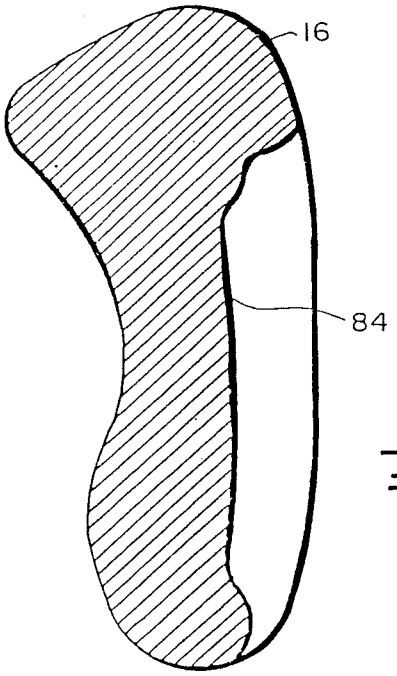
FIG. 9 is an enlarged detailed vertical sectional view taken along line 9—9 of FIG. 6.

Referring now more particularly to FIGS. 4–9, and with particular reference being made to the improved configuration of the stock 16, a pistol grip 80 is provided adjacent the trigger guard 24, and is contoured for nested engagement with the palm of the right hand of a user at 82 (FIGS. 5 and 8), and finger grip engagement at 84 (FIGS. 6 and 9). An abutment surface 86, better shown in FIGS. 1, 5, and 7 forms an engagement surface which nests between the thumb and the forefinger of the user (FIG. 1). As shown, the abutment surface of 86 constitutes a sideways projecting portion disposed above and behind the guard 24 and has a thumb engagement upper surface and forefinger engagement lower surface to form a finger engagement. As shown in FIG. 1, this allows a gun user to position his forefinger on the gun trigger and in engagement with the lower surface and have his thumb on the upper surface such that the sideways projecting portion or abutting surface 86 is nested between his thumb and forefinger. As also shown in FIG. 1, the pistol grip 80 has a downwardly contoured surface to accommodate three of the user's fingers. The forward elongated barrel portion of the stock 16 is best viewed in FIG. 4, and is so configured as to provide greater hand engagement surfaces in the regions 88, 90, and 92.

The forward portion 17 of the stock additionally has elongated recesses 94 for finger and hand engagement therein of a gun user.

It will be understood from the above that the described contour features incorporated in the stock 16, provides a user with greater controlled securement and positionment of the rifle. This structure permits the user to effect a firm forward gun fixed positioning, which coincidentally spaces the butt portion 28 of the stock 16 a distance from the shoulder of the user, and simultaneously firmly seats the back engagement member 62 to the user. These positionment features provide greater accuracy and elimination of recoil impact.

As shown, it will be appreciated that the sideways projecting portion 86 and the pistol grip portion 80 are integral with the gunstock 16. That is, they are not separate pieces which are attached together.

As shown in FIGS. 1 and 2, the sideways projecting portion 86 is disposed completely above the uppermost of the levels where trigger guard 24 has its upper ends 24A and 24B (labeled in FIG. 2 only). As also shown, the portion 86 is at least partially directly above the guard 24. This advantageous positioning for a good grip is further enhanced by having the forefinger engagement lower surface 86L (labeled in FIG. 5 only) extend downwardly towards the rifle front. As is apparent from FIG. 5, the lower surface 86L extends downwardly towards the front end of the rifle along the full length of the underside of the sideways projecting portion 86.

Figure 10:
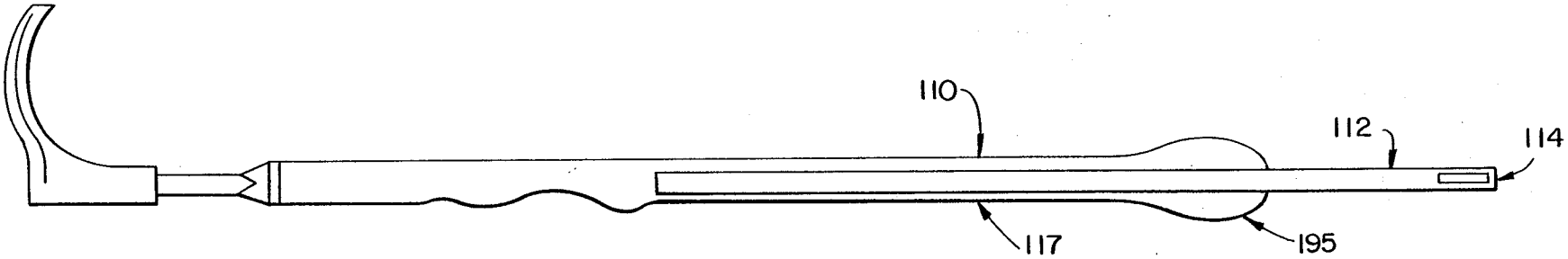
FIG. 10 is a top view of a second embodiment of the present invention.

FIG. 10 shows a top view of an alternate embodiment rifle 110 and includes components in the "100" series having the same last two digits as the corresponding component from the previously described embodiment of the present invention. The FIG. 10 embodiment is essentially identical to the previous embodiment except that the forearm or forward portion 117 of the gunstock 116 includes a flared out portion 195 at the forward end of the rifle. The flared out portion 195 allows one's front hand (not shown in FIG. 10) to clamp the forearm 117 just behind portion 195 so as to absorb the recoil. The forearm 117 does not include any of the recesses such as 94 in the embodiment shown in FIG. 4.

Figure 11:
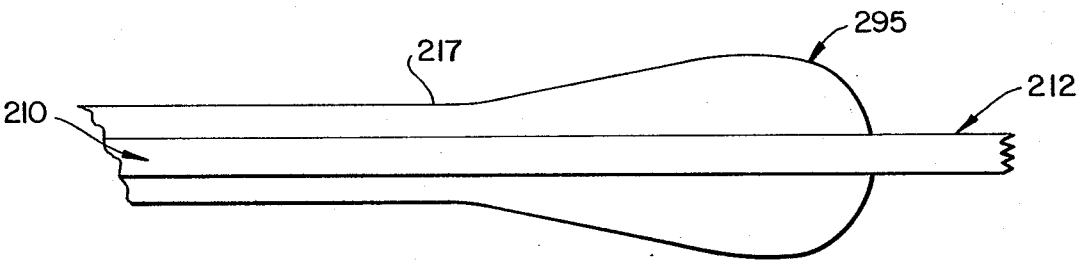
FIG. 11 is a top view of the forearm part of a third embodiment of the present invention.
Figure 12:
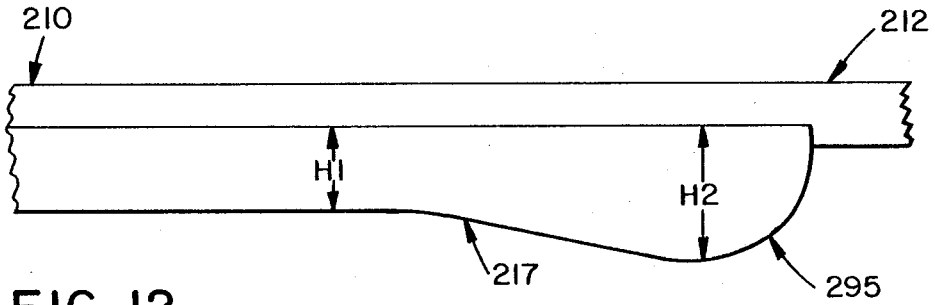
FIG. 12 is a side view of the forearm part of the third embodiment.

FIGS. 11 and 12 respectively show top and side views of part of a third embodiment firearm (a shotgun) 210 having components in the "200" series with the same last two digits as the corresponding component, if any, in the first and second embodiments. The firearm 210 includes a flared out gripping portion 295. As shown, the gripping portion 295 widens towards the front (right side of FIG. 11 and FIG. 12) of the rifle or firearm 210. Additionally, the gripping portion 295 is flared down for an increased forearm height towards the front. That is, as shown in FIG. 12, the height of the forearm increases as one gets close to the front or right end of the forearm 217 ("height" being the extent over which the forearm extends in a vertical direction). Thus, for example the height H2 is higher than the height H1. By having the forearm 217 flare out in width and height as shown for FIGS. 11 and 12, one can readily use one's hand (not shown) at or just behind (left side of FIGS. 11 and 12) the gripping portion 295 in order to absorb the recoil of the discharge of firearm 210.

It should also be noted that the gripping portion 195 of FIG. 10 would include a similar increase in height (not visible in the top view of FIG. 10) as shown with respect to H1 and H2 of the forearm 217 in FIG. 12.

The forearm 217 of FIGS. 11 and 12 is part of a gunstock which would include a separate piece constituting a butt end portion (not shown) which would be constructed identically to that portion of gunstock 16 (see especially FIG. 2) which is to the left of trigger 22 in FIG. 2.

While preferred embodiments of the invention have been herein shown and described, obviously changes in details can be affected without departing from the spirit and scope of the invention as defined in, and limited solely by, the appended claims.

What is claimed is:

1. A firearm having a barrel and a rearwardly extending gunstock when the firearm is in the firing position, and a gunstock attachment, said gunstock attachment comprising:

a butt plate attachable to the butt end of the gunstock;

a first gunstock extending member having a foot portion and a leg portion adapted to engage coacting means on the butt plate; and a second gunstock extending member including a body engaging arm member and a rod member, said rod member telescopically engaging the leg portion; and further comprising a gun trigger and guard mounted adjacent an integral portion of said gunstock which is contoured to form a piston grip for nesting engagement with a gun user's hand, said pistol grip having a downwardly contoured surface for engagement with three fingers of a gun user's hand, said gunstock including an integral sideways projecting portion disposed above and behind said guard and having a thumb engagement upper surface and a forefinger engagement lower surface, said upper surface and said lower surface being disposed such that a gun user may position a forefinger on the gun trigger and in engagement with said lower surface and a thumb on said upper surface with said sideways projecting portion nested between said thumb and forefinger, and wherein said trigger guard has a front upper end and a back upper end, and wherein said sideways projecting portion is disposed completely above the level of the back upper end, and, wherein said gunstock includes a forearm, said forearm having a gripping portion which widens towards a front end of the firearm and which is flared down for an increased forearm height towards said front, and wherein said sideways projecting portion is disposed completely above an uppermost level of said upper ends of said trigger guard.

2. A firearm as claimed in claim 1 wherein said sideways projecting portion has an underside and said lower surface extends downwardly towards said front end along the full length of the underside.

3. A firearm having a barrel and a rearwardly extending gunstock when the firearm is in the firing position, and a gunstock attachment, said gunstock attachment comprising:

a butt plate attachable to the butt end of the gunstock;

a first gunstock extending member having a foot portion and a leg portion adapted to engage coacting means on the butt plate; and a second gunstock extending member including a body engaging arm member and a rod member, said rod member telescopically engaging the leg portion; and further comprising a gun trigger and guard mounted adjacent an integral portion of said gunstock which is contoured to form a piston grip for nesting engagement with a gun user's hand, said pistol grip having a downwardly contoured surface for engagement with three fingers of a gun user's hand, said gunstock including an integral sideways projecting portion disposed above and behind said guard and having a thumb engagement upper surface and a forefinger engagement lower surface, said upper surface and said lower surface being disposed such that a gun user may position a forefinger on the gun trigger and in engagement with said lower surface and a thumb on said upper surface with said sideways projecting portion nested between said thumb and forefinger, and wherein said trigger guard has a front upper end and a back upper end, and wherein said sideways projecting portion is disposed completely above the level of the back upper end, and wherein said sideways projecting portion is disposed completely above an upper most level of said upper ends of said trigger guard.

4. A firearm as claimed in claim 3 wherein said sideways projecting portion has an underside and said lower surface extends downwardly towards said front end along the full length of the underside.

5. A firearm as claimed in claim 4 wherein said gunstock includes a forearm, said forearm having a gripping portion which flares out towards a front end of the firearm.

* * * * *